US008371079B2

(12) United States Patent
An et al.

(10) Patent No.: US 8,371,079 B2
(45) Date of Patent: Feb. 12, 2013

(54) REINFORCED MULL POST ASSEMBLY

(75) Inventors: Pao Yu An, Tustin, CA (US); Albert Lin, Rancho Palos Verdes, CA (US); Tong Mingyong, Wukang Town (CN)

(73) Assignee: Plastpro 2000, Inc., Los Angeles, CA (US)

( * ) Notice: Subject to any disclaimer, the term of this patent is extended or adjusted under 35 U.S.C. 154(b) by 0 days.

(21) Appl. No.: 13/194,784

(22) Filed: Jul. 29, 2011

(65) Prior Publication Data

US 2012/0073240 A1 Mar. 29, 2012

Related U.S. Application Data

(63) Continuation-in-part of application No. 12/693,552, filed on Jan. 26, 2010, now Pat. No. 8,230,652.

(60) Provisional application No. 61/148,652, filed on Jan. 30, 2009.

(51) Int. Cl.
*E06B 1/04* (2006.01)
*E04C 1/00* (2006.01)

(52) U.S. Cl. ..... 52/210; 52/309.7; 52/309.16; 52/204.1

(58) Field of Classification Search ..... 52/210, 52/211, 212, 309.15, 204.1, 656.4, 204.2, 52/656.2, 656.5, 716.8, 717.01, 717.02, 455–458, 52/847, 309.7, 309.16
See application file for complete search history.

(56) References Cited

U.S. PATENT DOCUMENTS

| | | | |
|---|---|---|---|
| 4,341,831 | A | 7/1982 | Kleiss |
| 4,717,185 | A | 1/1988 | Hartley |
| 4,858,384 | A | 8/1989 | Blankenship |
| 5,435,106 | A | 7/1995 | Garries et al. |
| 5,566,509 | A | 10/1996 | Long |
| 5,832,681 | A | 11/1998 | Johnson |
| 5,836,628 | A | 11/1998 | Beier |
| 5,848,505 | A | 12/1998 | Taylor |
| 6,003,277 | A | 12/1999 | Graham et al. |
| 6,148,582 | A | 11/2000 | Ellingson |
| 6,598,350 | B1 | 7/2003 | Suter |
| 7,467,818 | B2 | 12/2008 | Young |
| 7,543,416 | B2 | 6/2009 | Albertelli |
| 7,543,864 | B2 | 6/2009 | Barthel |
| 2002/0174610 | A1 | 11/2002 | Bennett et al. |
| 2006/0267238 | A1 | 11/2006 | Wang |

*Primary Examiner* — Mark Wendell
(74) *Attorney, Agent, or Firm* — Duane Morris LLP

(57) ABSTRACT

A composite reinforced mull post is disclosed for use in an entryway assembly. The mull post may engage a door on one side and a side light window on the other side. The mull post may comprise a one or two piece outer portion and one or more internal reinforcing members. The outer portion may comprise a plurality of interlocking pieces. The pieces may include a stop portion and a support portion, each with interlocking ribs. A first internal reinforcing member may be formed of engineered material such as a wood laminate, and a second reinforcing member may comprise a channel that extends partially around the first reinforcing member. The reinforcing member may include orthogonal portions conterminously received within a correspondingly shaped central chamber formed by the housing formed by the joined interlocking pieces.

21 Claims, 7 Drawing Sheets

REINFORCED MULL POST ASSEMBLY

CROSS-REFERENCE TO RELATED APPLICATIONS

This is a continuation-in-part application claiming priority to pending U.S. application Ser. No. 12/693,552 filed Jan. 26, 2010 which is a non-provisional application of co-pending U.S. provisional patent application Ser. No. 61/148,652, filed Jan. 30, 2009, the contents of each of which are hereby incorporated by reference as if set forth in their entireties.

TECHNICAL FIELD

The disclosure relates generally to mull posts for use in exterior or other door assemblies, and more particularly to a reinforced mull post for use in an exterior or other door assembly.

BACKGROUND

Entryway systems used in residential and commercial buildings include single and double door assemblies having one or more sidelights or sidelight panels flanking the door(s). Such entryway systems are typically fabricated using vertical mullions or mull posts positioned between the door(s) and the associated sidelight or sidelight panel to connect the structures. When these entryway systems are used in coastal regions of the country, it is desirable that the systems be capable of withstanding the extremely high pressures caused by high winds as well as impacts caused by flying debris.

Traditionally, mull posts have been fabricated from wood, such as pine, small pieces of which are finger jointed end to end and milled to form the mull profile. While such construction is acceptable in many regions, it generally does not result in mull posts that can withstand the extreme weather conditions that often occur in coastal areas. For instance, when an entryway having traditional wood mull posts is exposed to the high pressures from wind forces that entryways in coastal areas may experience, the forces transferred through the door to the mull posts can cause the mulls, and thus the entryway, to fail. Often the mulls break apart at the finger joints that are used to join the small segments of mull together. Even where the finger joints hold, the wood of the mulls can split apart along the grain at the locations of door hardware such as the strike plate, deadbolt strike; and hinges. Further, the high pressure can cause the mulls to deflect or bend, compromising the integrity of hardware fasteners. Thus, traditional finger jointed wood mull posts are not acceptable for use in regions with stringent design pressure requirements. Even where solid wood mull designs are used to eliminate failure at finger joint locations, problems caused by splitting of the wood along its grain remain.

More recently, extruded polymer mull posts made from inexpensive materials such as polyvinyl chloride (PVC) have been used. While polymer mull posts may not be as susceptible to breaking or splitting like traditional wood mulls, they still may be highly susceptible to deflection or bending when exposed to high pressure, thus compromising the integrity of the entryway system as previously explained.

In addition to the high design pressure requirements in hurricane prone regions, building codes in coastal regions also typically require that an entryway withstand a direct impact by airborne debris such as tree limbs. Traditional solid wood mull posts and extruded polymer mulls may be highly vulnerable to such impacts, again, for the reasons previously stated.

Thus, a need exists for an entryway system incorporating high strength mull posts that meet or exceed design requirements imposed by stringent building codes in coastal regions. Such mull posts should be inexpensive to produce, and should emulate the appearance of traditional wooden mulls so that they are acceptable for use in private residences.

SUMMARY

According to one aspect, a reinforced mull post assembly is disclosed. The reinforced mull post assembly, comprises: a mull post comprising a two piece housing formed by an elongated support piece and a stop piece coupled together by interlocking flanges, the support piece having external first and second support faces and the stop piece having first and second legs forming first and second raised stops laterally offset from the first and second support faces, respectively, the housing including a central chamber therein; the interlocking flanges including the stop piece having first flanges, each having a recess therein, and the support piece having second flanges, each second flange having a rib received within the corresponding recess of the corresponding first flange; the central chamber including a longitudinal void section and a transverse void section; and a reinforcing member disposed within the central chamber and including portions within the longitudinal void section and the transverse void section.

According to another aspect, a reinforced mull post assembly is disclosed. The reinforced mull post comprises: a mull post comprising a two piece housing formed by an elongated support piece and a stop piece coupled together by interlocking flanges, the stop piece having first and second legs forming first and second raised stops disposed laterally outside the support piece and offset from external surfaces of the elongated support piece, the housing including a central chamber therein. The interlocking flanges include the stop piece having first flanges and the support piece having second flanges, one of the first and second flanges having a protuberance and the other of the first and second flanges having a recess that receives the protuberance. The central chamber includes a longitudinal void section and a transverse void section; and a reinforcing member is disposed within the central chamber and including a longitudinal portion disposed within the longitudinal void section and a pair of opposed transverse portions received in the transverse void sections.

According to another aspect, a reinforced mull post assembly is disclosed. The reinforced mull post comprises: a mull post comprising a two piece housing formed by an elongated support piece and a substantially U-shaped stop piece coupled together by interlocking flanges, the support piece having first and second support faces and the substantially U-shaped stop piece having first and second ends forming first and second raised stops disposed laterally outside the support piece and offset from external surfaces of the elongated support piece, the two-piece housing including a central chamber therein; the interlocking flanges including the substantially U-shaped stop piece having first flanges and the support piece having second flanges, one of the first and second flanges having a protuberance and the other of the first and second flanges having a recess that receives the protuberance; the central chamber including a longitudinal void section and a transverse void section; and a reinforcing member disposed within the central chamber and formed of a different material than the substantially U-shaped stop piece and the support piece.

BRIEF DESCRIPTION OF THE DRAWING

The present disclosure is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

FIGS. 5A, 5B and 5D show individual components; FIG. 5C shows components partially assembled and FIG. 5E is a cross section view of another mull post assembly according to the disclosure;

DETAILED DESCRIPTION

Figure 1:
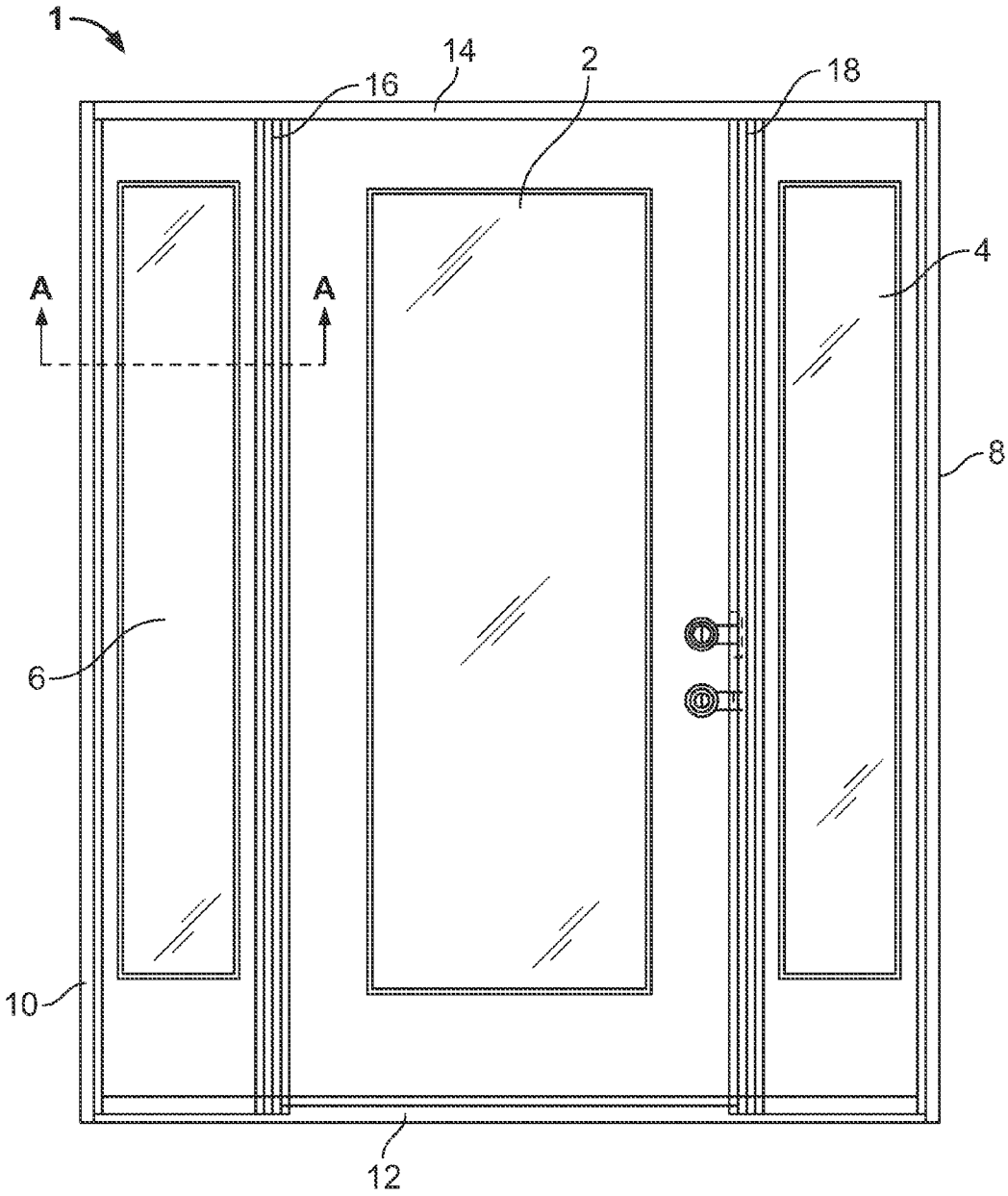
FIG. 1 is an elevation view of a door assembly incorporating an exemplary mull post design according to the disclosure.

Referring to FIG. 1, a typical exterior door assembly 1 comprises a central hinged door 2 and side light window panels 4, 6 that flank the door on either side. The exterior door assembly 1 further comprises a pair of vertical door jambs 8, 10 that extend between a sill 12 and a header 14. Together, the jambs 8, 10, the sill 12 and header 14 define the outer peripheral frame of the exterior door assembly 1. A pair of exemplary spaced mull posts 16, 18 extend vertically between the sill 12 and the header 14 and define a central opening in which the hinged door 2 is disposed, as well as two flanking side openings on either side of the door for receiving the side light window panels 4, 6.

Figure 2:
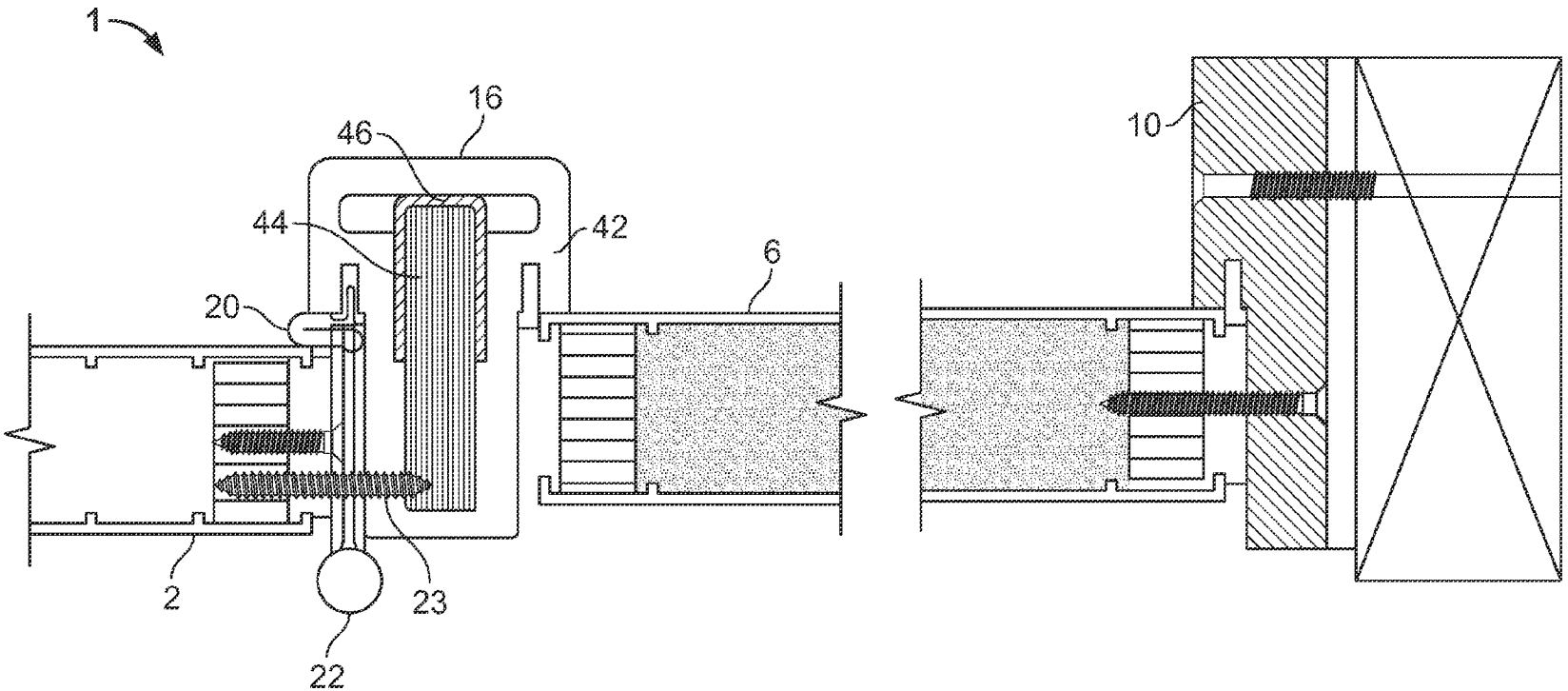
FIG. 2 is a cross section view of the door assembly of FIG. 1 taken along line A-A.

Referring to FIG. 2, a partial cross-section of the door assembly 1 is shown. As can be seen, the left-most exemplary mull post 16 is positioned between the left-most side light window panel 6 and the door 2. A piece of weather-stripping 20 is engaged between the exemplary mull post 16 and the door 2, and a door hinge 22 is shown fixing the door 2 to the exemplary mull post 16 by way of traditional threaded fasteners 23. Thus, the exemplary mull post 16 serves to provide both horizontal and lateral sealing of the door 2 and side light window panel 6.

Figure 3:
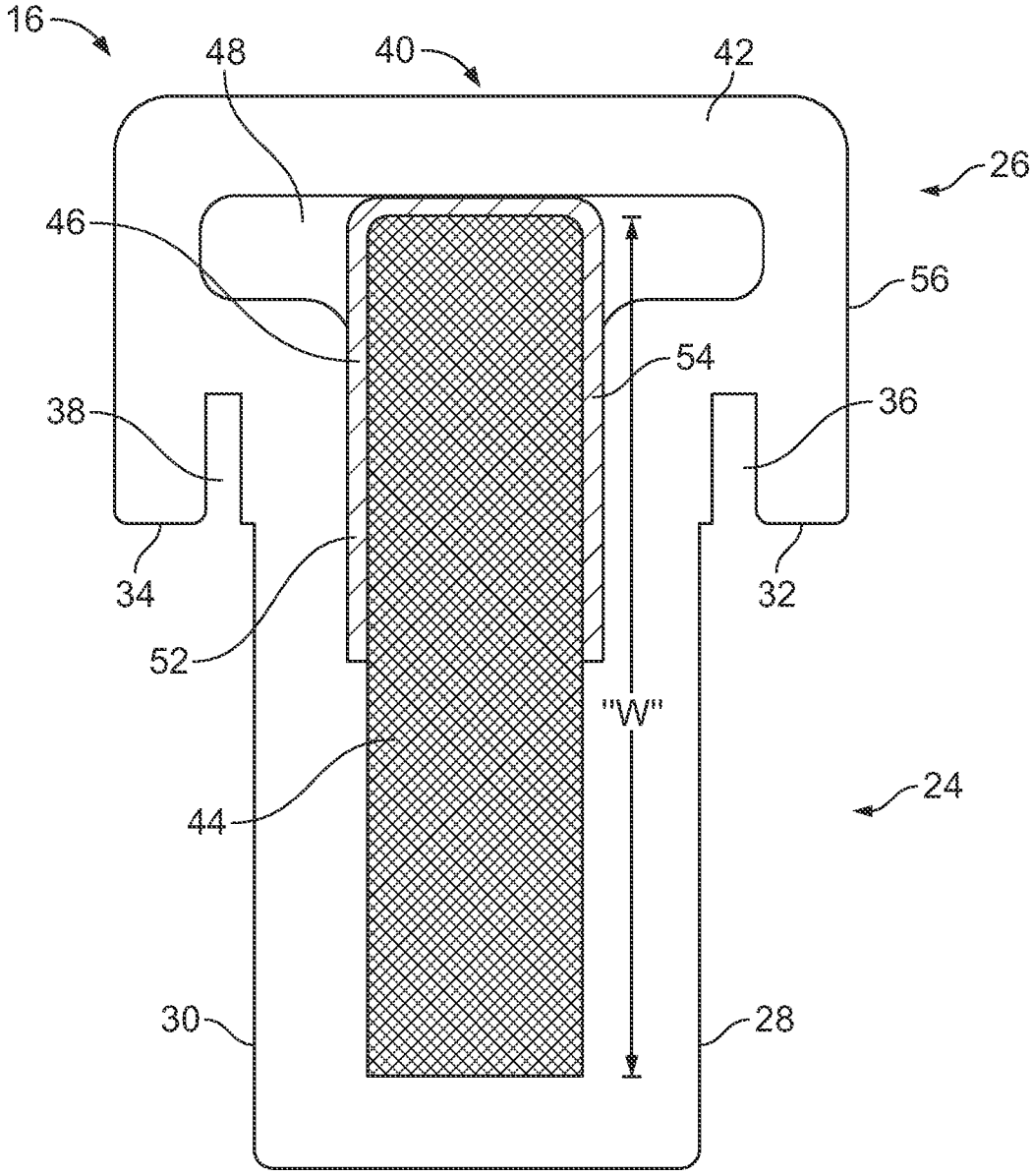
FIG. 3 is a cross section view of an exemplary mull post design according to the disclosure.

Referring now to FIG. 3, a cross-section of the exemplary mull post 16 is shown. Although the description will proceed with reference to mull post 16, it will be appreciated that the identical description also applies to mull post 18. Furthermore, the exemplary mull post 16 illustrated in FIG. 3 represents one exemplary mull post assembly according to the disclosure. Another exemplary mull post assembly is illustrated in FIGS. 5A-7 and may be substantially disposed within exterior door assembly 1 such as exemplary mull post 16 is disposed, as illustrated in FIG. 3.

Again referring to FIG. 3, the mull post 16 has a support portion 24 and a stop portion 26. The support portion 24 comprises first and second support faces 28, 30 for engaging respective end surfaces of the side light panel 6 and door 2 to provide a desired lateral offset between the two. The stop portion 26 comprises first and second raised stops 32, 34 for engaging respective side surfaces of the side light panel 6 and door 2 to provide a desired horizontal positioning of each within the door assembly 1. Defined within each of the first and second raised stops 32, 34 is a longitudinal slot 36, 38 that extends along the length of the vertical mull post 16. These longitudinal slots 36, 38 are sized and shaped to receive weather stripping 20 and/or a tab fixture (FIG. 2) for engaging and sealing the door 2 and side light 6 to the mull post 16.

The stop portion 26 of the mull post 16 may further have an exposed face portion 40 that extends along the length of the mull post 16 and is exposed to the exterior of the building in which the door assembly 1 is installed. In the illustrated embodiment, this exposed face portion 40 is flat, however, it will be appreciated that a the face portion may be provided in any of a variety of different decorative shapes to result in a desired external appearance for the mull post 16. This exposed face portion 16 may have a surface that can be painted or otherwise finished in any manner to provide the appearance of a traditional wood mullion.

While the external appearance of the mull post 16 provides the look of a single-piece construction, the interior of the exemplary mull post 16 of FIG. 3 is made up of multiple components that reinforce the mull post and provide a desired high degree of strength and rigidity. Thus, the mull post 16 may comprise an outer polymer profile portion 42 with first and second reinforcing members 44, 46 sandwiched within. The polymer profile portion 42 incorporates the external physical features as previously described. It also comprises a hollow center 48 sized and shaped to receive the first and second reinforcing members 44, 46.

In one embodiment, the polymer profile portion 42 that includes support portion 24 and stop portion 26, is fabricated from a thermoplastic material, such as polyvinyl chloride (PVC), and is formed using an extrusion process, although other formation processes such as molding may also be used. The first reinforcing member 44 may comprise engineered wood, such as laminated veneer lumber (LVL). The second reinforcing member 46 may comprise a steel U-channel that wraps around one end of the first reinforcing member 44 to further enhance the strength and rigidity of the resulting mull post 16.

The material of the polymer profile portion 42 may be any of a variety of thermosetting polymers, a non-limiting list of which includes PVC, PE (Polyethylene), PP (Polypropylene), ABS (Acrylonitrile Butadiene Styrene), PC (Polycarbonate), PS (Polystyrene), NYLON and TEFLON. The hollow center 48 may be formed during the extrusion process (where an extrusion process is used), or it may be formed after the profile portion is formed (e.g., by machining from of a solid formed profile).

Figure 4:
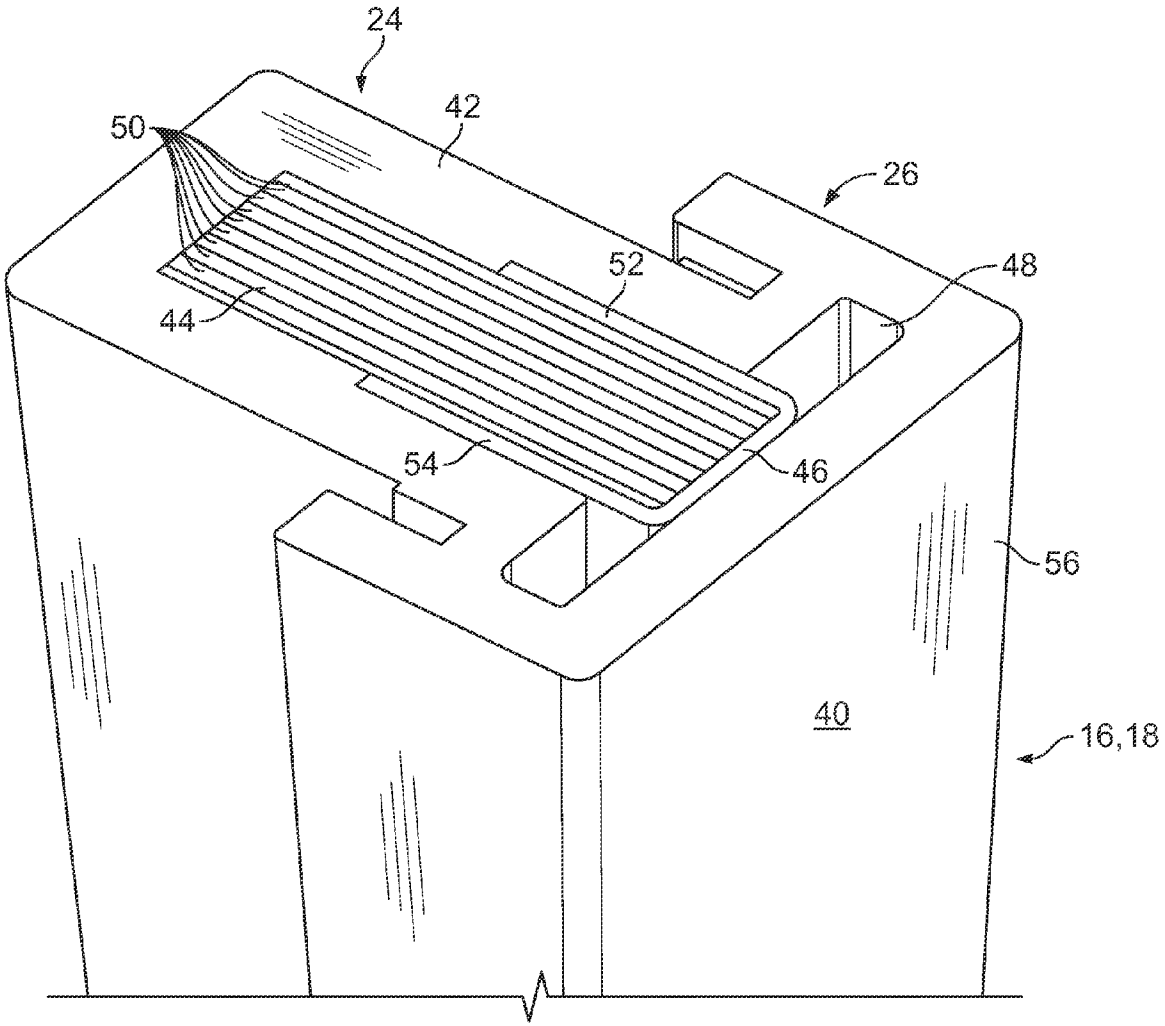
FIG. 4 is a cutaway perspective view of the exemplary mull post design of FIG. 3.

The first reinforcing member 44 may comprise a sold piece of wood or other material (e.g., a second polymer), or it may comprise plurality of individual plies 50 of material glued or otherwise adhered together to form a multiple ply structure (see FIG. 4). As will be appreciated, the material and structure of the plies 50 may be varied depending upon the ultimate use and desired strength of the mull post 16. For instance, the first reinforcing member 44 may be a traditional engineered lumber product such as LVL, which uses multiple layers of thin wood assembled with adhesive. LVL offers several advantages over solid wood in that it is stronger, straighter, and more uniform. It is also much less likely than conventional lumber to warp, twist, bow, or shrink due to its composite nature. Another appropriate engineered material for use as the first reinforcing member 44 is parallel strand lumber (PSL), which is manufactured from large flakes of wood. Where LVL is used, the types of wood used to form the veneers of the plies 50 may vary and the plies may be oriented such that their grains extend in different directions to enhance the strength of the member. Various types of LVL and PSL are available from vendors of engineered lumber and are well known by those of skill in the art.

As an alternative to LVL or PVL, the first reinforcing member 44 may be formed from plies 50 made of a mixture of wood and other materials to enhance the strength of the member. For example, some of the plies 50 may be wood veneers while other plies may be plastic, carbon composite, fiberglass, or metal such as aluminum. The use of such non-wooden plies combined with wooden plies may form a first reinforcing member 44 of exceptional strength and resistance to failure under even the most severe load conditions.

As noted, the second reinforcing member 46 may comprise a steel U-channel that wraps around one end of the first reinforcing member 44. In the illustrated embodiment, the second reinforcing member 46 is positioned so that it wraps around the first reinforcing member 44 at the end immediately adjacent the stop portion 26 of the mull post 16 to provide support to the exposed face portion 40, and to provide the mull post with maximum rigidity against flexure in use. As can be seen, the second reinforcing member 42 does not extend the entire width "W" (FIG. 3) of the first reinforcing member 44. This ensures that fasteners (such as for attaching hinges or other connecting hardware) can be easily screwed through the support portion 24 of the mull post 16 and into the first reinforcing member 44. In the illustrated embodiment, the leg portions 52, 54 of the second reinforcing member 46 extend approximately one half the width "W" of the first reinforcing member 44. Depending on the application, the leg portions 52, 54 may extend over greater or lesser percentages of the width "W" of the first reinforcing member 44.

As will be appreciated, the second reinforcing member 46 may be provided in shapes other than the U-shape illustrated in the figures. For example, the second reinforcing member 46 could simply comprise a flat metal member positioned on one broad flat side of the first reinforcing member 44, running the entire length of the mull post 16. Alternatively, a pair of flat metal members could be positioned on opposite broad sides of the first reinforcing member 44. In addition, any of a variety of metals can be used, a non-limiting list of which includes aluminum, steel, stainless steel and copper. Further, highly-rigid non-metals such as fiberglass, graphite reinforced polymers, and the like could also be used to form the second reinforcing member 46.

In addition, it will be appreciated that the mull post 16 may be provided with a profile portion 42 and only a single reinforcing member. Thus, in one embodiment the mull post 16 may comprise the profile portion 42 and only the first reinforcing member 44. In another alternative embodiment the mull post 16 may comprise the profile portion 42 and only the second reinforcing member 46.

Where the polymer profile portion 42 is formed by an extrusion process, a cap stock layer 56 may be co-extruded onto the profile portion 42 to provide protection to the profile portion 42 to increase weatherability (e.g., resist UV rays), and to provide a desired finished exterior appearance and/or color to the mull post 16. This cap stock layer 56 may comprise PVC, and may be provided in a thickness range of about 0.4 to about 0.6 millimeters. In one embodiment, the cap stock layer 56 is applied in a thickness of about 0.6 millimeters.

As discussed above, with prior solid wood or finger jointed wood mullions, the attachment points of the hinges to the mullion tend to be regions of failure under extreme wind induced pressures on the door. With the disclosed reinforce mull post, however, the screws that attach the hinges (and other door hardware) to the mull post extend deeply into the multiple plies of the first reinforcing member 44. Since the grains of the plies 50 can be oriented in various directions, the tendency for inward force at the locations of the hinges to split the mullion along its length is minimized. Furthermore, threading screws into a multiply material such as LVL is expected to form a far stronger attachment as compared to treading screws into the solid pine of traditional mullions. Accordingly, the screws will not be pulled out of the mull post under the stress of extreme pressure induced forces. This is expected to be even more true where the truss may include plies of non-wooden materials such as plastic or metal.

Although the disclosed designs have been disclosed for use in mull post applications, it may also be used to advantage to form the vertical door jambs 8, 10, sills 12 and headers 14 of the door assembly 1. Often, however, only the mull posts 16 are formed using the disclosed reinforced design because the strength of the jambs, sills and headers is not as critical as that of the mull posts since the jambs, sills and header are typically secured directly to the heavy construction framing of the opening into which the door assembly installed. As such, forces imparted to the jambs are typically transferred directly to the framing timbers and splitting and failure of the jambs generally is less a problem that failure of the otherwise unsupported mullion members.

The disclosed mull posts 16, 18 may be attached at their top and bottom ends with screws or other appropriate fasteners to the sill 12 and header, respectively.

With the disclosed door assembly 1 installed in a dwelling that is subjected to the high winds of a hurricane or other storm, the door and panels can be subjected to extreme pressures and consequently extreme inwardly directed forces. These forces are transferred from the door and panels to the reinforced mull posts of the entryway, which, due to their reinforced construction, resist the failure modes common for traditional mull posts and transom mulls. Ultimately, much of the force born by the mull posts 16, 18 are transferred to the vertical jambs 8, 10, the sill 12 and the header 14, and, in turn, to the framing timbers of the building.

Figure 5A:
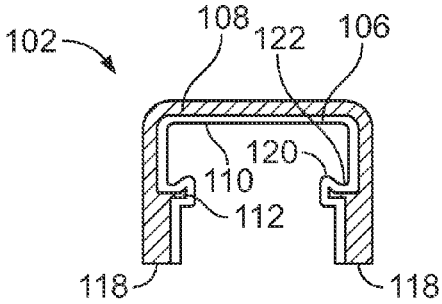
FIGS. 5A-5E are cross section views of another exemplary mull post assembly according to the disclosure.
Figure 5B:
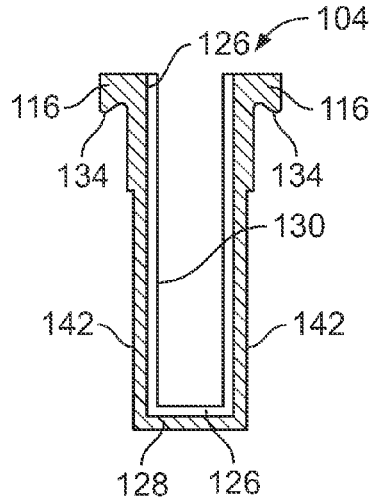
Figure 5C:
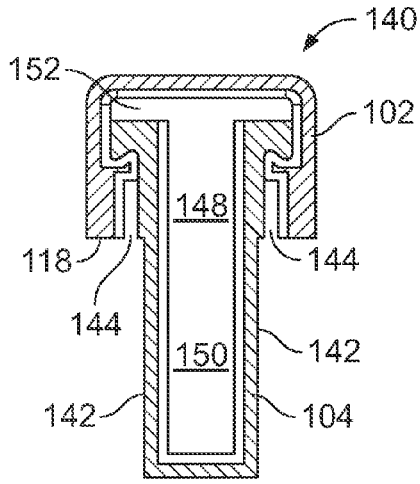
Figure 5D:
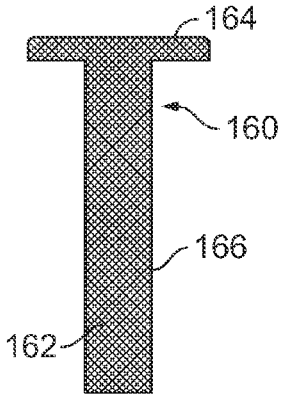
Figure 5E:
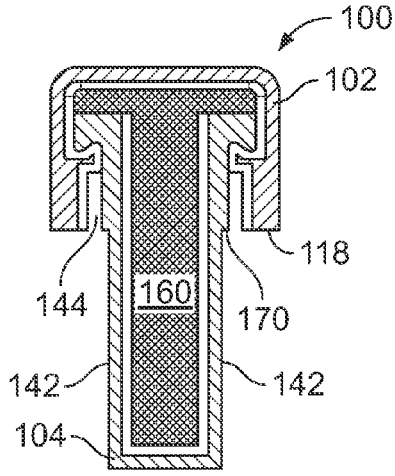

A further exemplary mull post design in shown in FIGS. 5A-5E. Each of these figures represents a cross-sectional view with FIGS. 5A-5D illustrating various components in various arrangements and FIG. 5E showing a cross-sectional view of an exemplary mull post assembly including all components. Exemplary mull post 100 is an alternative embodiment to the mull post shown in FIG. 3. Exemplary mull post 100 shown in FIG. 5E may be similarly situated within exterior door assembly 1 such as exemplary mull post 16 illustrated in FIG. 3, e.g. exemplary mull post 100 may extend vertically between sill 12 and header 14 as does exemplary mull posts 16 and 18 illustrated and described in FIGS. 1 and 2.

Now turning to FIGS. 5A-5E, stop component 102 of FIG. 5A combines with support component 104 of FIG. 5B to form a housing with a central cavity such as shown in FIG. 5C. Stop component 102 and support component 104 are separate members. Stop component 102 and support component 104 may be separately manufactured and securely fastened together. Glue or other adhesives may be optionally used in some exemplary embodiments.

Stop component 102 includes internal portion 106 and external portion 108 in the illustrated embodiment. According to other exemplary embodiments, stop component 102 may be formed of a single composition, i.e. a single material. Internal portion 106 may be formed of rigid PVC, polyvinyl chloride, in one exemplary embodiment but may be formed of other suitable polymers, plastics and rigid materials and other exemplary embodiments. External portion 108 may be advantageously formed of wood or a wood composite in one exemplary embodiment but may be formed of plastics, polymers, PVC or other suitable components in other exemplary embodiments. External portion 108 may advantageously have a wood grain outer appearance in one exemplary embodiment. Internal portion 106 includes surface 110 which will be a smooth surface in various exemplary embodiments to aid in slidably receiving an internal reinforcing member when stop component 102 is joined to support component 104. Stop component 102 includes opposed flanges 112 which may alternatively be described as ribs. Flanges 112 each extend laterally inward from the opposed sides of generally U-shaped stop component 102 and are adapted to engage with corresponding flanges 116 of support component 104 shown in FIG. 5B. Opposed flanges 116 may alternatively be described as ribs. Returning to FIG. 5A, stop component 102 is generally U-shaped and in the illustrated exemplary embodiment includes first and second stops 118. Flanges 112 include protuberances 120 generally in the shape of a hump, and recesses 122. The opposed side of each flange 112 is substantially flat. Stop component 102 may be formed to various suitable dimensions and it can be seen that the lower portions of stop component 102 near stops 118 in the inverted U configuration illustrated in FIG. 5A, are thicker than portions above the flanges 112 in the illustrated embodiment. This is exemplary only. Flanges 112, including protuberances 120 and recesses 122 may also take on various other shapes.

Support component 104 is longitudinal in shape and includes internal portion 126 and external portion 128. Internal and external portions 126 and 128 may be as described for corresponding internal and external portions 106 and 108, respectively, of FIG. 5A, e.g. internal and external portions 126, 128 may be formed of different materials according to one exemplary embodiment. According to another exemplary embodiment, support component 104 may also be formed of a single material and not separate internal and external portions 126 and 128 as illustrated. Inner surface 130 is a smooth internal surface such as surface 110 and may be mechanically smoothed or polished to aid in slidably receiving a tight-fitting reinforcement member therein. Support component 104 includes opposed flanges 116 and flanges 116 interlock with flanges 112 of stop component 102 to form a housing. Opposed flanges 116 and flanges 116 are substantially parallel to one another as flanges 112 extend laterally inward from the opposed sides of stop component 102 and flanges 116 extend laterally outward from the opposed sides of support component 104. More particularly, flanges 116 each include downwardly extending rounded ribs 134 that are received within corresponding recesses 122 of flanges 112 to interlock support component 104 and stop component 102 are together as shown in FIG. 5C. It should be understood that the configuration and shape of flanges 112 and 116 are exemplary only and various other interlocking features that utilize ribs and cooperating recesses, may be used in other exemplary embodiments.

FIG. 5C shows housing 140 consisting of stop component 102 and support component 104 joined together. Housing 140 includes raised stops 118 similar to raised stops 32, 34 of FIGS. 1 and 2, for engaging respective side surfaces of the side light panel 6 and door 2 to provide a desired horizontal positioning of each within the door assembly 1. Exemplary mull post 100, like exemplary mull post 16 as illustrated in FIG. 3, includes first and second support faces 142 and longitudinal slots 144 that extend along the length of exemplary mull post 100. These longitudinal slots 144 may be sized and shaped to receive weather stripping and/or a tab fixture for engaging and sealing the door and side light to the mull post 100, as described in conjunction with previous illustrations.

Housing 140 defines central chamber 148 which is "T" shaped in the exemplary embodiment and includes longitudinal void section 150 and orthogonally oriented transverse void sections 152.

T-shaped reinforcement member 160 is shown in FIG. 5D. T-shaped reinforcement member 160 may be formed of LVL (laminated veneer lumber) wood, other engineered wood products, metal, various fiberglass composites or fiberglass reinforced materials. T-shaped reinforcement member 160 may comprise a solid piece of wood or other material such as described in conjunction with first reinforcing member 44 shown in FIG. 3. T-shaped reinforcement member 160 may be formed of different materials than support component 104 and stop component 102 in one exemplary embodiment.

According to another exemplary embodiment, T-shaped reinforcement member 160 may be partially or completely surrounded by a second reinforcing member such as second reinforcing member 46 shown in FIG. 3 and the second reinforcing member may be formed of materials such as described for second reinforcement member 46. According to one exemplary embodiment, a second reinforcement member may be disposed along the upper portions of T-shaped reinforcement member 160 in the illustrated orientation, and substantially fill transverse void sections 152. The orthogonal shape of T-shaped reinforcing member 160 includes longitudinal portion 162 and transverse portions 164 and provides additional stability and strength to the assembled mull post 100 shown in FIG. 5E. T-shaped reinforcement member 160 includes surfaces 166 which may be slid along surface 110 and inner surface 130 when mull post 100 is assembled by inserting T-shaped reinforcement section 160 within housing 140 shown in FIG. 5C.

Mull post 100 shown in FIG. 5E includes stop component 102, support component 104 and T-shaped reinforcement member 160 securely positioned within central cavity 148 shown in FIG. 5C. T-shaped reinforcement member 160 may be advantageously received conterminously within and filling central cavity 148. In the illustrated embodiment, T-shaped reinforcement member 160 includes longitudinal portion 162 and transverse portions 164 and is received within central chamber 148 to provide strength and stability. In other exemplary embodiments, an alternative reinforcement member having a substantially rectangular cross-section may be used. According to either exemplary embodiment, the reinforcement member may be partially or completely surrounded by a second reinforcement member as described supra. The alternative reinforcement member and second reinforcement member may combine to form a T-shaped component to be snugly received within central chamber 148.

Stop component 102, support component 104 and T-shaped reinforcement member 160 may be securely joined by tight mechanical fittings in combination with the interlocking flanges/ribs or glue or other suitable adhesives may optionally be applied along the interfaces.

Longitudinal slots 144 have a constant width in the illustrated embodiment as first and second support faces 142 each include a thicker ridge portion 170 that defines longitudinal cavity 144.

Figure 6:
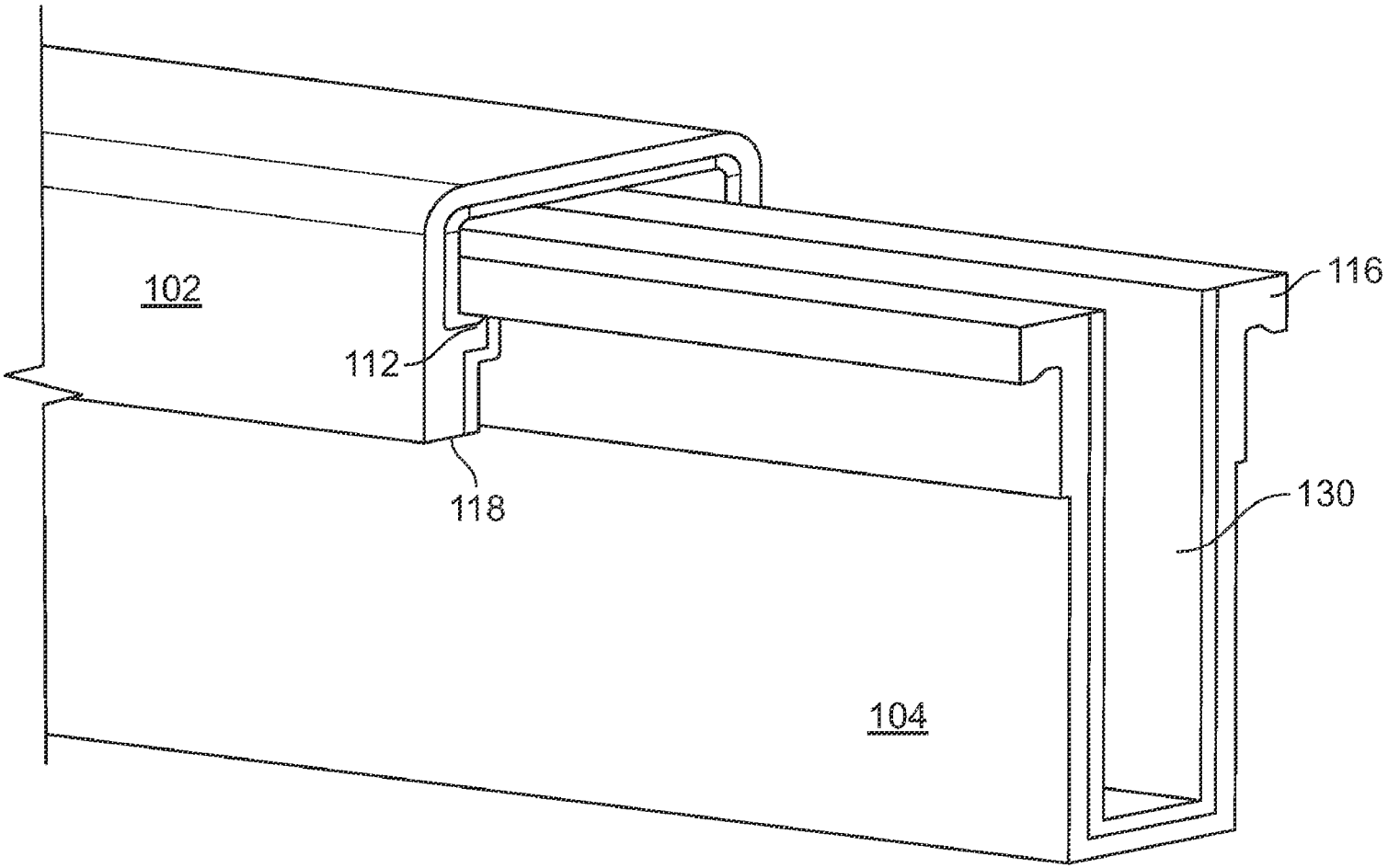
FIG. 6 is a cutaway perspective view of components of the exemplary mull post assembly of FIGS. 5A-5B.
Figure 7:
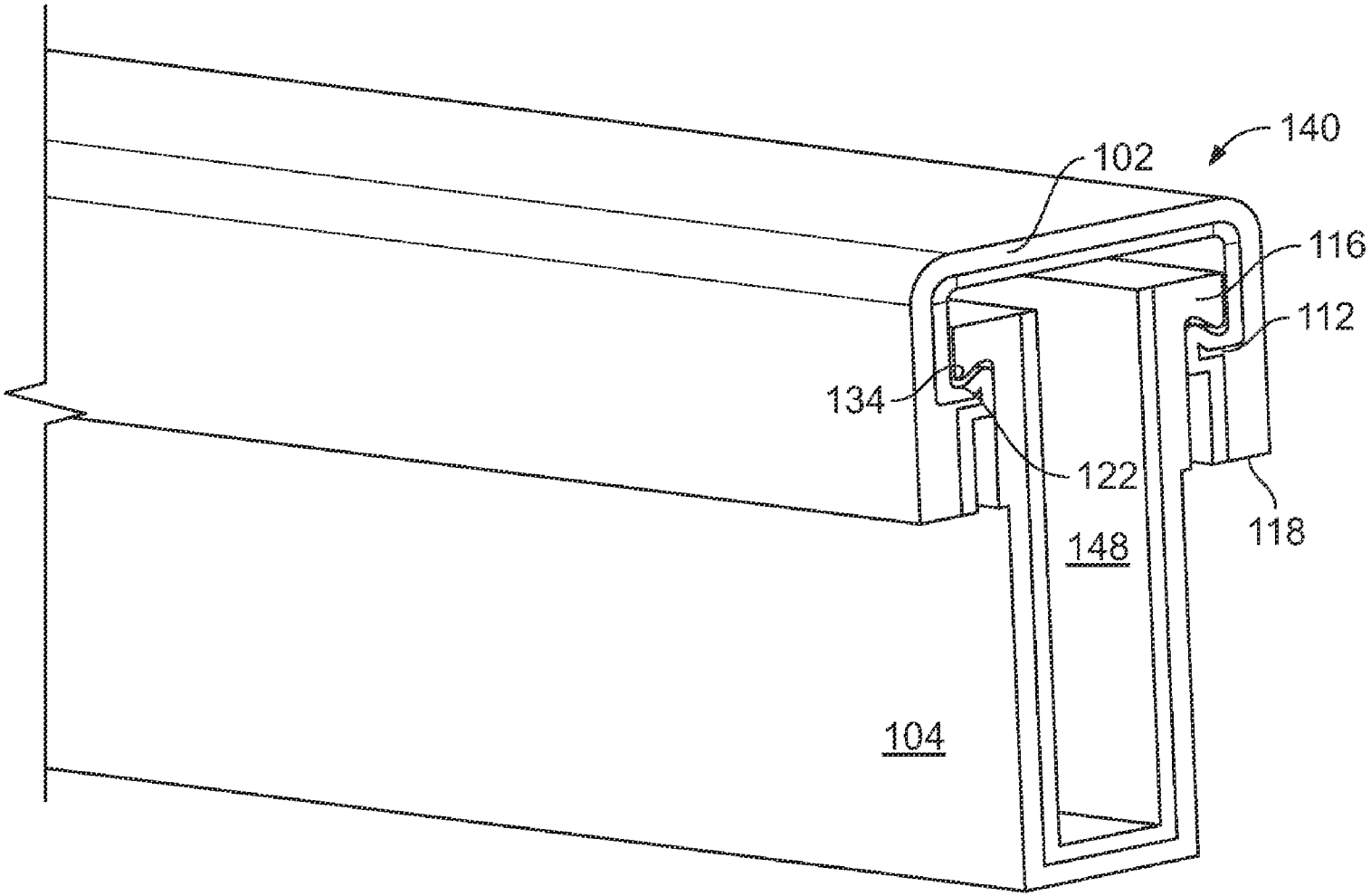
FIG. 7 is another cutaway perspective view of components of the exemplary mull post assembly of FIGS. 5A-5B.

FIGS. 6 and 7 are perspective views of portions of exemplary mull post 100. Each of FIGS. 6 and 7 shows stop component 102 and support component 104. FIG. 6 shows the components being joined together by translation, i.e. slid into position and FIG. 7 shows stop component 102 and support component 104 joined to form housing 140 defining therein central chamber 148 and including stops 118 and corresponding flanges 112 and 116. Central chamber 148 is T-shaped and may receive therein one or more reinforcement members that may be T-shaped, rectangular or may take on other shapes such as more than one reinforcement member combining to form a T-shape. The polished and smooth nature of inner surface 130 and surface 110, make it easy to insert a corresponding reinforcement member of the same dimension as central chamber 148, within central chamber 148 by sliding.

It should be understood that the embodiments disclosed herein are merely illustrative of the principles of the disclosure. Various other modifications may be made by those skilled in the art which will embody the principles of the disclosure and fall within the spirit and the scope thereof. For instance, the disclosed reinforced mull posts may be used in window frames as well as entryways and may be applied to entryways with a transom and a single sidelight. Application to entryways of other configurations also is envisioned.

What is claimed is:

1. A reinforced mull post assembly, comprising:

a mull post comprising a two piece housing formed by an elongated support piece and a stop piece coupled together by interlocking flanges, the support piece having opposed external first and second support faces and the stop piece having first and second legs forming first and second raised stops laterally offset from the first and second support faces, respectively, the housing including a central chamber therein;

the interlocking flanges including the stop piece having first flanges, each having a recess therein, and the support piece having second flanges, each second flange having a rib received within a corresponding recess of the corresponding first flange;

the central chamber including a longitudinal void section and a transverse void section; and a reinforcing member disposed within the central chamber and including portions within the longitudinal void section and the transverse void section.

2. The reinforced mull post assembly of claim 1, wherein the elongated support piece extends in a longitudinal direction and the first and second flanges each extend substantially orthogonal to the longitudinal direction.

3. The reinforced mull post assembly of claim 1, wherein the reinforcing member is a T-shaped single member and substantially fills the central chamber.

4. The reinforced mull post assembly of claim 3, wherein the reinforcing member comprises one of engineered wood material and laminated veneer lumber (LVL) wood.

5. The reinforced mull post assembly of claim 1, further comprising a further reinforcing member disposed within the central chamber in cooperation with the reinforcing member, the further reinforcing member being made from a material that is different than that of the reinforcing member.

6. The reinforced mull post assembly as in claim 5, wherein the further reinforcing member is formed of steel and at least partially surrounds the reinforcing member.

7. The reinforced mull post assembly of claim 1, wherein the reinforcing member is slidably received within the central chamber.

8. The reinforced mull post assembly of claim 1, wherein the elongated support piece includes an external portion formed of a wood composite and an internal portion formed of a different material.

9. The reinforced mull post assembly of claim 8, wherein the different material comprises PVC.

10. The reinforced mull post assembly of claim 1, wherein the stop piece is substantially U-shaped and includes an external portion formed of a wood composite and an internal portion formed of a different material.

11. The reinforced mull post assembly of claim 1, wherein the stop piece is substantially U-shaped and the first flanges extend transversely inwardly, each first flange including an upper surface being substantially flat and a lower surface including a hump adjacent to the recess.

12. The reinforced mull post assembly of claim 11, wherein the second flanges extend outwardly from the opposed external first and second support faces of the elongated support piece and the ribs extend upwardly.

13. The reinforced mull post assembly of claim 1, wherein the second flanges extend outwardly from the opposed external first and second support faces of the elongated support piece and the ribs extend upwardly.

14. The reinforced mull post assembly of claim 1, wherein the stop piece is substantially U-shaped and the two piece housing includes the elongated support piece received partially within the stop piece.

15. The reinforced mull post assembly of claim 1, wherein the first and second raised stops are laterally offset from the first and second support faces by respective slots configured to receive a tab member of an adjacent structure or a length of weather stripping for sealing the mull post to an adjacent structure.

16. A reinforced mull post, comprising:

a mull post comprising a two piece housing formed by an elongated support piece and a stop piece coupled together by interlocking flanges, the stop piece having first and second legs forming corresponding first and second raised stops disposed laterally outside the elongated support piece and offset from external surfaces of the elongated support piece, the housing including a central chamber therein;

the interlocking flanges including the stop piece having opposed first flanges and the support piece having opposed second flanges, one of the first and second flanges having a protuberance and the other of the first and second flanges having a recess that receives the protuberance;

the central chamber including a longitudinal void section and a transverse void section; and a reinforcing member disposed within the central chamber and including a longitudinal portion disposed within the longitudinal void section and a pair of opposed transverse portions received in the transverse void sections.

17. The reinforced mull post of claim 16, wherein external surfaces of the elongated support piece comprise opposed first and second support faces, the first and second legs are substantially parallel to the first and second support faces, the opposed first flanges extend substantially orthogonally inwardly from the first and second legs and the opposed second flanges extend substantially orthogonally outwardly from the first and second support faces of the elongated support piece.

18. The reinforced mull post of claim 16, wherein the first and second flanges each extend substantially transverse to the elongated support piece and the first and second raised stops are laterally offset from the first and second support faces by respective slots configured to receive a tab member of an adjacent structure or a length of weather stripping for sealing the mull post to an adjacent structure.

19. A reinforced mull post assembly, comprising:

a mull post comprising a two piece housing formed by an elongated support piece and a substantially U-shaped stop piece coupled together by interlocking flanges, the elongated support piece having first and second support faces and the substantially U-shaped stop piece having first and second ends forming first and second raised stops disposed laterally outside the support piece and offset from the first and second support faces of the elongated support piece, the two-piece housing including a central chamber therein;

the interlocking flanges including the substantially U-shaped stop piece having opposed first flanges and the support piece having opposed second flanges, one of the first and second flanges having a protuberance and the other of the first and second flanges having a recess that receives the protuberance;

the central chamber including a longitudinal void section and a transverse void section; and a reinforcing member disposed within the central chamber and formed of a different material than the substantially U-shaped stop piece and the elongated support piece.

20. The reinforced mull post assembly of claim 19, wherein the opposed first flanges extend substantially orthogonally inwardly from opposed sides of the substantially U-shaped stop piece and the opposed second flanges extend substantially orthogonally outwardly from the first and second support faces of the elongated support piece.

21. The reinforced mull post assembly of claim 19, wherein the reinforcing member includes a plurality of components formed of different materials that combine to form a T-shaped member that substantially fills the longitudinal void section and transverse void section of the central chamber.

* * * * *